US005759013A

United States Patent [19]

Miyazaki et al.

[11] Patent Number: 5,759,013

[45] Date of Patent: Jun. 2, 1998

[54] OIL PUMP APPARATUS

[75] Inventors: Hisashi Miyazaki; Ichiro Kimura; Kongo Aoki; Yoshinori Miura, all of Aichi-pref., Japan

[73] Assignee: Aisin Seiki Kabushiki Kaisha, Kariya, Japan

[21] Appl. No.: 786,024

[22] Filed: Jan. 21, 1997

[30] Foreign Application Priority Data

| | | | |
|---|---|---|---|
| Jan. 19, 1996 | [JP] | Japan | 8-007296 |
| Jun. 21, 1996 | [JP] | Japan | 8-162162 |
| Aug. 29, 1996 | [JP] | Japan | 8-228985 |

[51] Int. Cl.[6] ..... F04B 49/00; F04C 15/02

[52] U.S. Cl. ..... 417/310; 418/15

[58] Field of Search ..... 417/310, 282, 417/292, 299; 418/15

[56] References Cited

U.S. PATENT DOCUMENTS

| | | | |
|---|---|---|---|
| 2,509,321 | 5/1950 | Topanelian, Jr. . | |
| 3,628,893 | 12/1971 | Carpigiani | 418/15 |
| 4,631,009 | 12/1986 | Cygnor et al. | 418/15 |
| 4,658,583 | 4/1987 | Shropshire . | |
| 5,660,531 | 8/1997 | Merkle et al. | 418/15 |

FOREIGN PATENT DOCUMENTS

| | | |
|---|---|---|
| 2159672 | 4/1996 | Canada . |
| A-712997 | 5/1996 | European Pat. Off. . |
| 1303685 | 8/1961 | France . |
| 1324941 | 2/1962 | France . |
| A-3520884 | 1/1986 | Germany . |
| A-3837599 | 5/1990 | Germany . |
| 61-23485 | 2/1986 | Japan . |
| 7-42445 | 8/1995 | Japan . |
| 7-233787 | 9/1995 | Japan . |
| 8-114186 | 5/1996 | Japan . |

*Primary Examiner*—Timothy Thorpe
*Assistant Examiner*—Peter G. Korytnyk
*Attorney, Agent, or Firm*—Hazel & Thomas, P.C.

[57] ABSTRACT

An oil pump apparatus incorporates, an oil pump housing, and a rotor located in the oil pump housing, wherein the rotor forms a first set of pockets having a capacity increasing toward the rotating direction of the rotor and a second set of pockets having a capacity decreasing toward the rotating direction of the rotor. The apparatus further includes a plurality of suction ports connected with the first set of pockets, each of the suction ports being isolated from other adjacent suction ports, a discharge port connected with the second set of the pockets, and a control valve.

6 Claims, 9 Drawing Sheets

OIL PUMP APPARATUS

FIELD OF THE INVENTION

The present invention relates to a pump apparatus for a vehicle, and more particularly, a pump apparatus which has a higher pressure when revolution of a drive source, for example a crank shaft of an internal combustion engine, increases.

BACKGROUND OF THE INVENTION

A conventional pump apparatus includes a suction port, a discharge port, a rotor and a drive source which causes the rotor to rotate. When the revolving speed of the rotor is increased, the amount of discharged oil from the discharge port is increased so that the oil pump apparatus causes the pressure to increase. As a result, more than a necessary amount of the oil is discharged by the oil pump.

A conventional oil pump apparatus is disclosed in, for example, Japanese Utility Model Patent laid-open Application No.61(1986)-23485. This reference discloses an oil pump apparatus having a drive source and two gear pumps in one body. When the drive source rotates at low speed, the oil pump apparatus drives the two gear pumps to obtain the necessary amount of the oil. When the drive source rotates at high speed, the oil pump apparatus drives only one of the two gear pumps so that the oil pump is able to avoid discharging more than a necessary amount of the oil and thereby working efficiency is improved.

This conventional oil pump apparatus needs two gear pumps, however, such that it is disadvantageous for the oil pump application to be compact and to mount the oil pump on the vehicle body.

The conventional oil pump apparatus with a relief valve 200 is shown in FIG. 13. The oil pump apparatus includes a pump body 202, a rotor 204 and a relief valve 200. The pump body 202 has a suction port 206 and a discharge port 208. The rotor 204 has a plurality of teeth and is located in a room 210 of the pump body 202. The relief valve 200 operates, correspondingly to the pressure of the discharge port 208. When the revolution of the rotor 204 increases and the pressure of the discharge port 208 reaches a predetermined pressure (P1), the pressure of the discharge port 208 makes the relief valve 200 open against a spring of the relief valve 200. Therefore, an excessive amount of pressured oil is discharged from a relief port of the relief valve 200.

This oil pump apparatus, however, reaches a pressure more than the predetermined pressure (P1) such that the oil pump apparatus works excessively and is inefficient.

SUMMARY OF THE INVENTION

Accordingly, it is an object of the present invention to provide an oil pump apparatus without the foregoing drawbacks.

In accordance with the present invention, an oil pump apparatus comprises an oil pump housing, a rotor located in the oil pump housing that forms a first set of pockets having a capacity that increases toward the rotating direction of the rotor and a second set of pockets having a capacity that decreases toward the rotating direction of the rotor, a plurality of suction ports connected with the first set of pockets, each of the suction ports being isolated from adjacent suction ports located on both sides of the suction port, a discharge port connected with the second set of the pockets, and a control valve.

Other objects and advantages of invention will become apparent during the following description of the accompanying drawings.

BRIEF DESCRIPTION OF THE DRAWING FIGURES

The foregoing and additional features of the present invention will become more apparent from the following detailed description of preferred embodiments thereof when considered with reference to the attached drawings, in which.

DETAILED DESCRIPTION OF THE PREFERRED EMBODIMENTS

Figure 1:
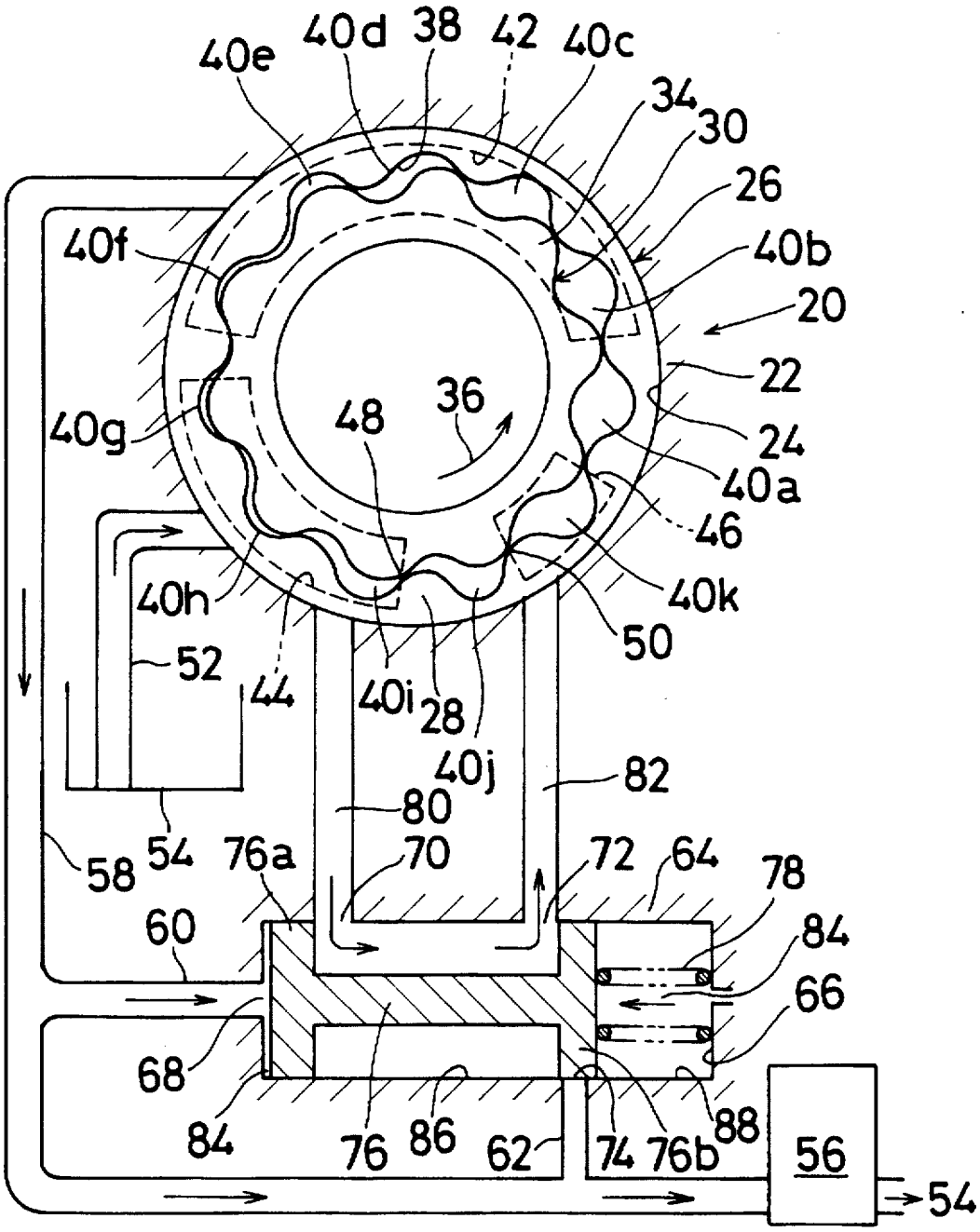
FIG. 1 is a diagrammatic illustration view of an oil pump apparatus, when the revolving speed of the rotor is at low speed.

Referring to FIG. 1, there is shown a first preferred embodiment of an oil pump apparatus. The oil pump apparatus is adapted for mounting on a vehicle and is actuated by a crankshaft of an internal combustion engine. An oil pump 20 of the pump apparatus is provided with an oil pump housing 22 which is made of metal, such as an aluminum-based alloy or an iron-based alloy. In the oil pump housing 22, a pump chamber 24 is formed. In the pump chamber 24, an outer rotor 26 is disposed which is provided with a plurality of internal gear teeth 28 so as to constitute a driven gear. Further, in the pump chamber 24, an inner rotor 30 is disposed rotatably therein and is located inside the outer rotor 26. An axis of the outer rotor 26 and an axis of the inner rotor 3O are placed within a predetermined distance. The inner rotor 30 is connected to the crank shaft 32 of an internal combustion engine, and is rotated together with the crank shaft 32. In general, the inner rotor 30 is designed to rotate at a revolving speed of 600 to 7,000 rpm.

On an outer periphery of the inner rotor 30, a plurality of external gear teeth 34 is provided so as to constitute a drive gear. The internal gear teeth 28 and the external gear teeth 34 are designed to be a trochoid curve or a cycloid curve.

The inner rotor 30 is rotated in the direction of the arrow 36 of FIG. 1. As the inner rotor 30 is rotated, the external gear teeth 34 of the inner rotor 30 engage with the internal gear teeth 28 of the outer rotor 26 one after another, accordingly, the outer rotor 26 is rotated in the same direction. Between the internal gear teeth 28 and the external gear teeth 34, there are formed eleven pockets 40*a* through 40*k* as shown in FIG. 1. In FIG. 1, the pocket 40*a* has the largest volume of the pockets 40*a* through 40*k* and the pocket 40*f* has the smallest volume.

The pockets 40*g* through 40*k*, disposed in the upstream with respect to the pocket 40*a*, produce an inlet pressure, because their volumes enlarge as the inner rotor 30 is rotated, and they act to suck the hydraulic oil. The pockets 40*b* through 40*f*, disposed in the downstream with respect to the pocket 40*a*, produce an outlet pressure, because their volumes diminish as the inner rotor 30 is rotated, and they act to discharge the hydraulic oil.

In the oil pump housing 22 of the oil pump 20, a discharge port 42 is formed. The discharge port 42 is connected to the pockets 40*b* through 40*f*, and is adapted to discharge the hydraulic oil out of the pump chamber 24 as the inner rotor 30 is rotated. In the oil pump housing 22, two suction ports 44 and 46 are formed. The suction port 44 is connected to the pockets 40*g* through 40*i* and the suction port 46 is connected to the pockets 40*k*.

In the first preferred embodiment, the suction port 46 is disposed downstream with respect to the suction port 44 in the rotary direction of the inner rotor 30 designated at the arrow 36. The opening area of the suction port 44 is larger than the opening area of the suction port 46. As can be appreciated from FIG. 1, the contact points 48 and 50 between the internal gear teeth 28 and the external gear teeth 34 are positioned between the suction port 44 and the suction port 46. Accordingly, the suction port 44 and the suction port 46 communicate with each other along the peripheral direction of the pump chamber 24. Thus, the suction port 44 and the suction port 46 are adapted to suck the hydraulic oil independently of each other. One end of a suction hydraulic passage 52 is connected to the suction port 44 and the other end of the suction hydraulic passage 52 is connected to an oil store member, such as an oil pan 54, a reservoir, or an oil tank. The hydraulic oil is returned to the oil pan 54 from a hydraulic oil receiving unit 56.

A hydraulic-oil-delivery passage 58 is a passage which is adapted for delivering a hydraulic pressure of the hydraulic oil to the hydraulic oil receiving unit 56. The hydraulic-oil-delivery passage 58 has a first branch passage 60 and a second branch passage 62.

A control valve 64 is located in the oil pump housing 22. The control valve 64 is provided with a valve chamber 66, a first valve port 68, a second valve port 70, a third valve port 72, a fourth valve port 74, a spool 76 and a spring 78. The first valve port 68 is communicated with hydraulic-oil-delivery passage 58 via the first branch passage 60. The second valve port 70 is communicated with the suction port 44 via a first intermediate hydraulic passage 80. The third valve port 72 is communicated with the suction port 46 via a second intermediate hydraulic passage 82. The fourth valve port 74 is communicated with the hydraulic-oil-deliver passage 58 via the second branch passage 62. Note that the spool 76 is fitted into the valve chamber 66, and is urged by the spring 78 in the direction of the arrow 84 of FIG. 1. The spool 76 has a first spool portion 76*a* and a second spool portion 76*b*. The valve chamber 66 is divided into three rooms which are a head room 84, an intermediate room 86 and a back room 88 by first spool portion 76*a* and the second spool portion 76*b* as shown in FIG. 1. The first valve port 68 is communicated with the head room 84. The second valve port 70 is controlled to communicate with the head room 84 or the intermediate room 86 by the first spool portion 76*a*, according to the pressure in the head room 84. The third valve port 72 and the fourth port 74 are controlled to open or close by the second spool portion 76*b*, according to the pressure in the head room 84.

Figure 2:
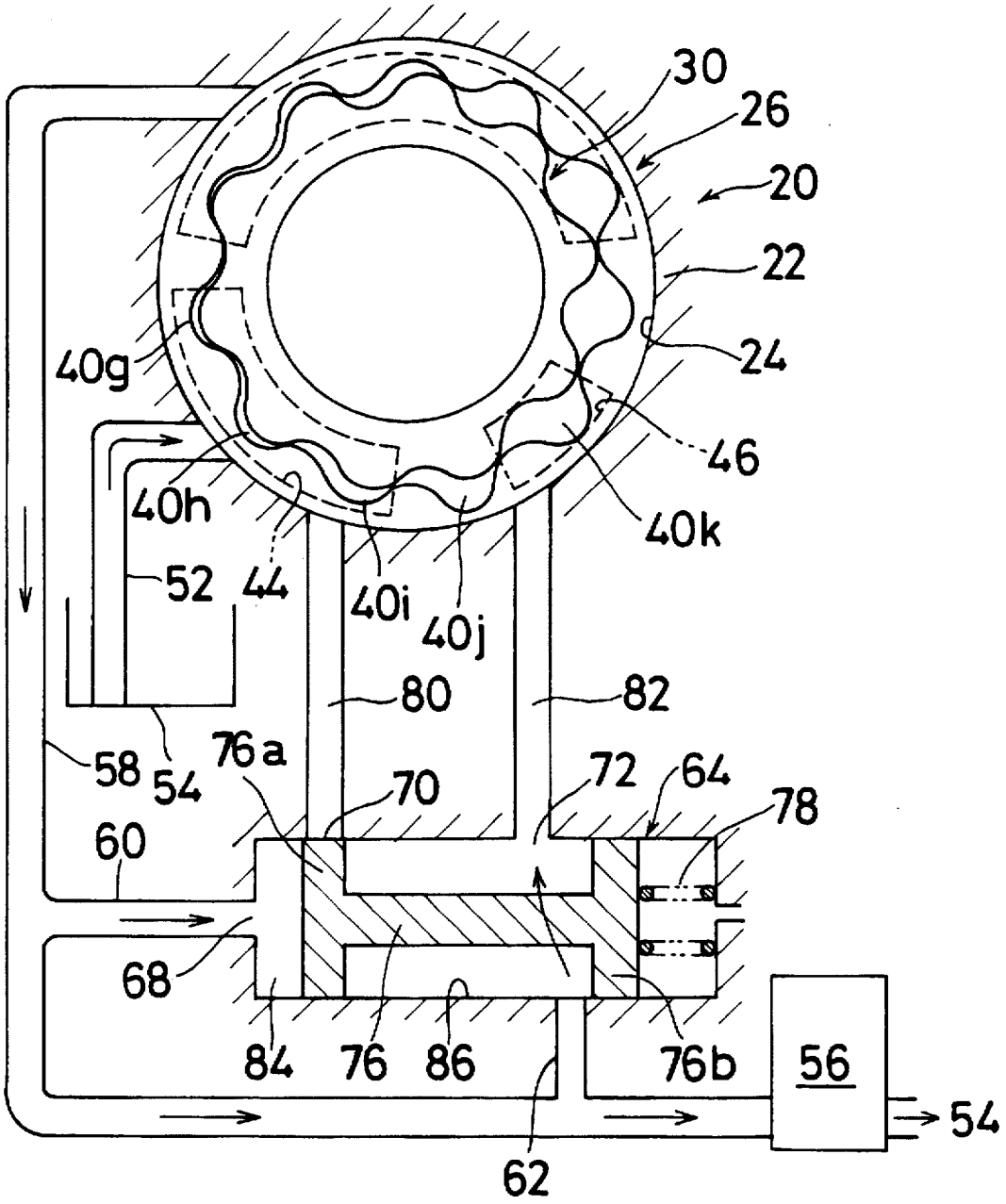
FIG. 2 is a diagrammatic illustration view of an oil pump apparatus, when the revolving speed of the rotor is at middle speed.
Figure 3:
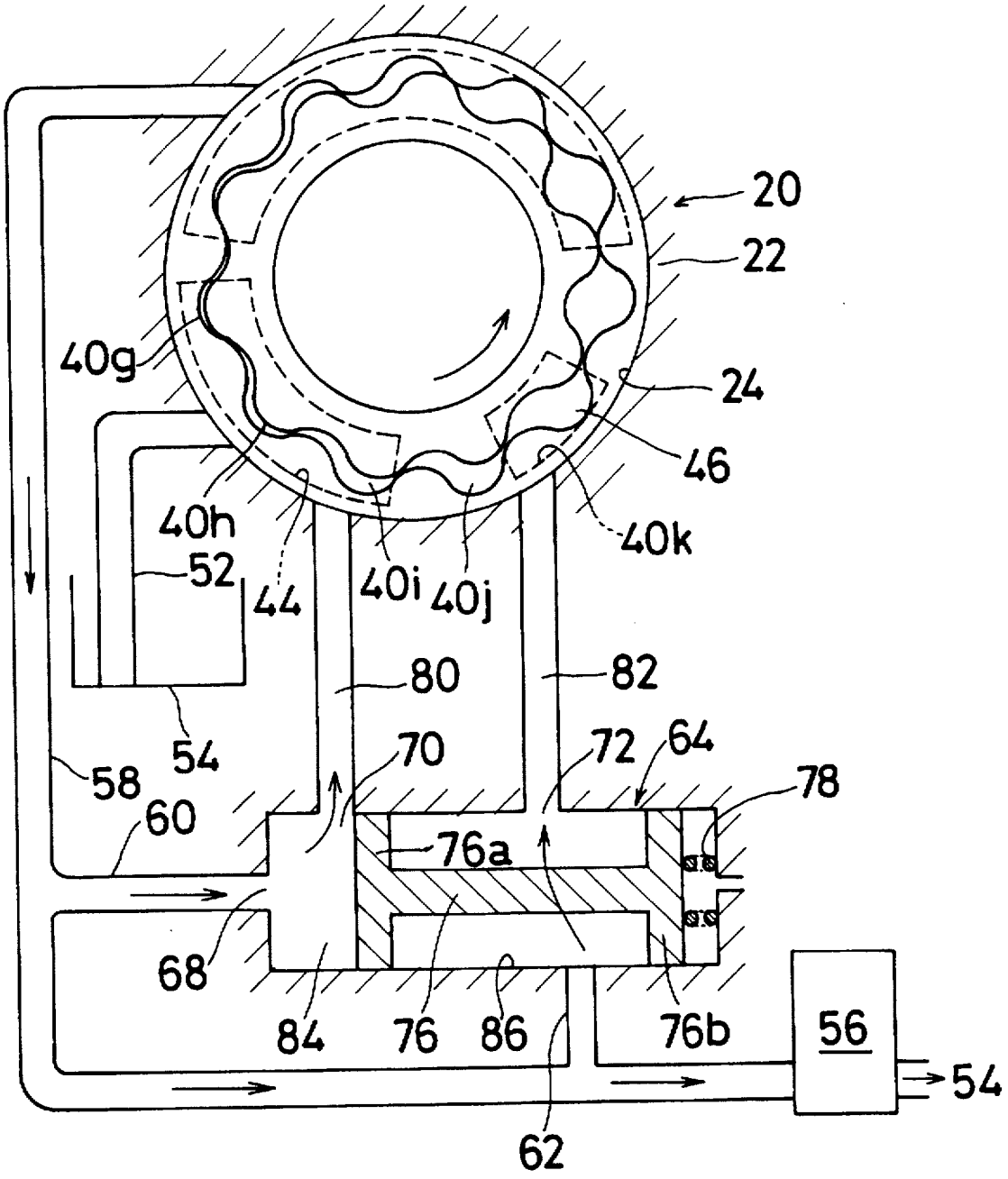
FIG. 3 is a diagrammatic illustration view of an oil pump apparatus, when the revolving speed of the rotor is a high speed.

Therefore, the control valve 64 is able to engage either a first condition where the second valve port 70 and the third valve port 72 communicate with each other so as to communicate the suction port 44 with the suction port 46, a second condition where the second valve port 70 and the third valve port 72 are closed and the second branch passage communicates with the suction port 46, or a third condition where the first valve port 68 and the second valve port 70 communicate with each other and the second branch passage communicates with the suction port 46 of the oil pump 20. FIGS. 1 through 3 show the first condition through the third condition, respectively. Further, the first intermediate hydraulic passage 80, the second intermediate hydraulic passage 82, the first branch passage 60, the second branch passage, a part of the hydraulic passage 52 and a part of the hydraulic-oil-delivery passage 58 are located in the oil pump housing 22.

An operation of the first preferred embodiment of the present oil pump apparatus will be hereinafter described.

As the revolving speed of the crankshaft of the internal combustion engine increases, the revolving speed of the inner rotor 30 increases. When the revolving speed of the inner rotor 30 is low (first condition), the pressure of the hydraulic-oil-delivery passage 58 does not slide the spool 76 against the spring 78 so that the suction port 44 and the suction port 46 communicate with each other. This means that the pockets 40*g* through 40*k* are able to suck the hydraulic oil, as shown in FIG. 1. Therefore, in the oil pump 20, the pockets 40*g* through 40*k* suck the hydraulic oil from the oil pan 54 via the suction ports 44 and 46, and the pockets 40*b* through 40*e* discharge the hydraulic oil to the hydraulic-oil-delivery passage 58 via the discharge port 42. The discharged hydraulic oil is delivered to the hydraulic oil receiving unit 56. In this case, the characteristic of the total outlet amounts, whose revolving speed is low (revolving speed N, O<N<N1), is obtained as shown in FIG. 5.

Figure 5:
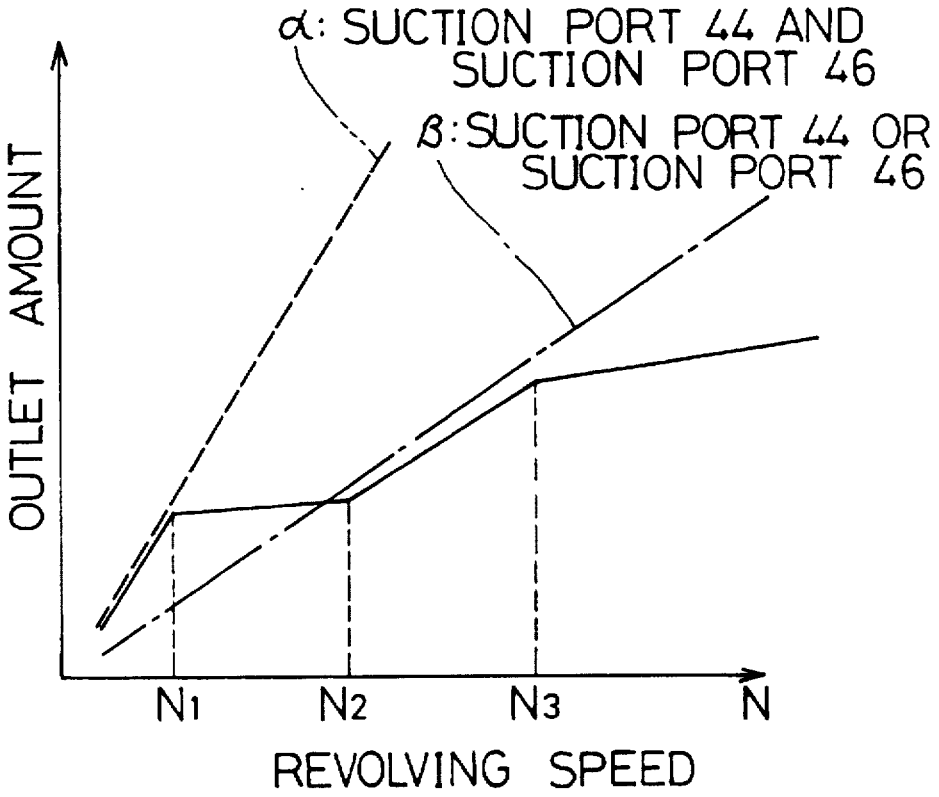
FIG. 5 is a graph illustrating an outlet-amount characteristic, which is exhibited by the oil pump apparatus in accordance with the present invention.

FIG. 5 is a graph, which schematically illustrates the relationships between the revolving speeds of the internal combustion engine and the outlet amounts of the first preferred embodiments of the oil pump apparatus. The dotted line "α" of the drawing specifies that the characteristic of the total outlet amounts, which are sucked from both of the suction ports 44 and 46. The alternate-long-and-dash line "β" of the drawing specifies that the characteristic of the outlet amounts, are sucked from either the suction port 44 or the suction port 46.

Figure 4:
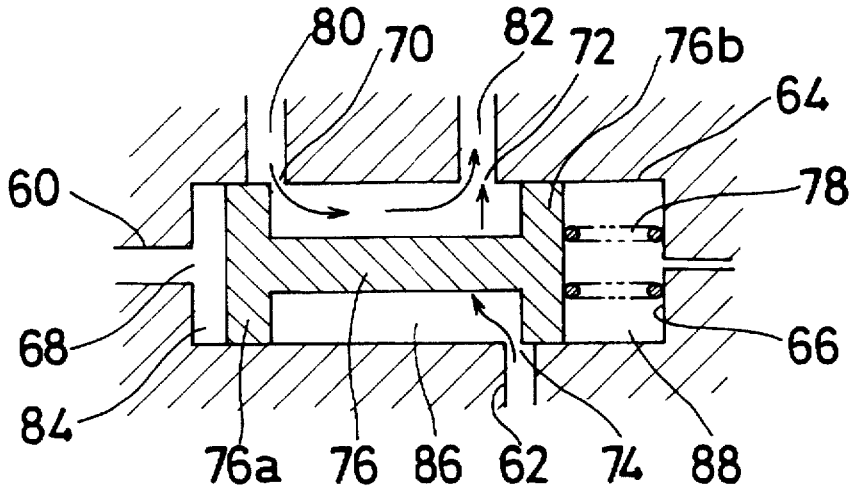
FIG. 4 is a sectional view of a valve when the revolving speed of the rotor is from low speed to middle speed, in accordance with the present invention.

On the other hand, when the revolving speed of the internal combustion engine is from N1 to N2, for instance, from 1,500 rpm to 2,500 rpm, the revolving speed of the inner rotor 30 is increased accordingly. Under the circumstances, the amount of the hydraulic oil discharged out of the discharge port 42 is increased, and thereby the hydraulic pressure is increased to more than a predetermined pressure (Pm) in the hydraulic-oil-delivery passage 58. Eventually, the spool-actuating force in the head room 84 is increased to overcome the urging force of the spring 78, and accordingly, as can be understood from FIG. 4, the spool 76 is moved in the rightward direction (shown in FIG. 1) while contracting the spring 78 elastically. Thus, the spool 76 of the control valve 64 is placed at the transition condition as shown in FIG. 4. In the transition condition, the spool portion 76*a* closes a part of the second valve port 70 and the spool portion 76*b* opens a part of the fourth valve port 74, and thereby the suction port 44 (the pockets 40*g* through 40*i*) sucks the hydraulic oil from the oil pan 54, and the suction port 46 (the pocket 40*k*) sucks the hydraulic oil from the suction port 44 via the first intermediate hydraulic passage 80, the part of the second valve part 70, the intermediate room 86, the third port 72 and the second intermediate hydraulic passage 82. At the same time, the suction port 46 sucks the hydraulic oil from the hydraulic-oil-delivery passage 58 via the second branch passage 62, the part of the fourth valve port 74, the intermediate room 86, the third port 72 and the second intermediate hydraulic passage 82. In this case, the characteristic of the total outlet amounts, whose revolving speed area is in the transition condition (N1<N<N2), is obtained as shown in FIG. 5.

When the revolving speed of the internal combustion engine is from N2 to N3, for instance, from 2,500 rpm to 4,000 rpm, the revolving speed of the inner rotor 30 is further increased accordingly. As can be understood from FIG. 2, the spool-actuating force in the head room 84 is increased to overcome the urging force of the spring 78, and accordingly, the spool 76 is moved in the rightward direction of FIG. 2. Thus, the spool 76 of the control valve 64 is placed at the second condition, whose revolving speed is at middle speed. In the second condition, the spool portion 76*a* closes the second valve port 70 and the third valve part 72 is communicated with the fourth valve port 74. The suction port 44 (the pockets 40*g* through 40*i*) sucks the hydraulic oil from the oil pan 54. At the same time, the suction port 46 sucks the hydraulic oil from the hydraulic-oil-delivery passage 58 via the second branch passage 62, the part of the fourth valve port 74, the intermediate room 86, the third port 72 and the second intermediate hydraulic passage 82. In this case, the characteristic of the total outlet amounts, whose revolving speed area is the second condition (N2<N<N3), is obtained as shown in FIG. 5. As also shown in FIG. 5, the characteristic of the total outlet amounts of the second condition is the difference of the characteristic of the suction port 46 subtracted from the characteristic of the total outlet amounts whose revolving speed area is low.

Furthermore, when the revolving speed of the internal combustion engine is increased, for instance, to more than 4,000 rpm, the revolving speed of the inner rotor 30 is increased accordingly. As can be understood from FIG. 3, the spool-actuating force in the head room 84 is increased to overcome the urging force of the spring 78 and, accordingly, the spool 76 is moved in the rightward direction of FIG. 3. Thus, the spool 76 of the control valve 64 is placed at the third condition, whose revolving speed is high. In the third condition, the first branch passage 60 communicates with the suction port 44. Therefore, both the suction ports 44 and 46 suck the hydraulic oil from the hydraulic-oil-delivery passage 58. In this case, the characteristic of the total outlet amounts, whose revolving speed area is the third condition (N3<N), is obtained as shown in FIG. 5.

FIGS. 6 to 9 illustrate a modified version of the first preferred embodiment, which specifically is a modified construction of the control valve 64. In this modified construction, the second branch passage 62 is eliminated and a first valve port 90 of the control valve 92 communicates with the second intermediate hydraulic passage 82 directly. In addition, a valve chamber 94 is provided with a third valve port 96. The second valve port 96 has a side passage 98 whose length of the direction of the valve chamber 94 is longer than the length of the sliding range of a spool 100.

In this construction, the characteristic of the total outlet amounts is also obtained as shown in FIG. 5.

Figure 6:
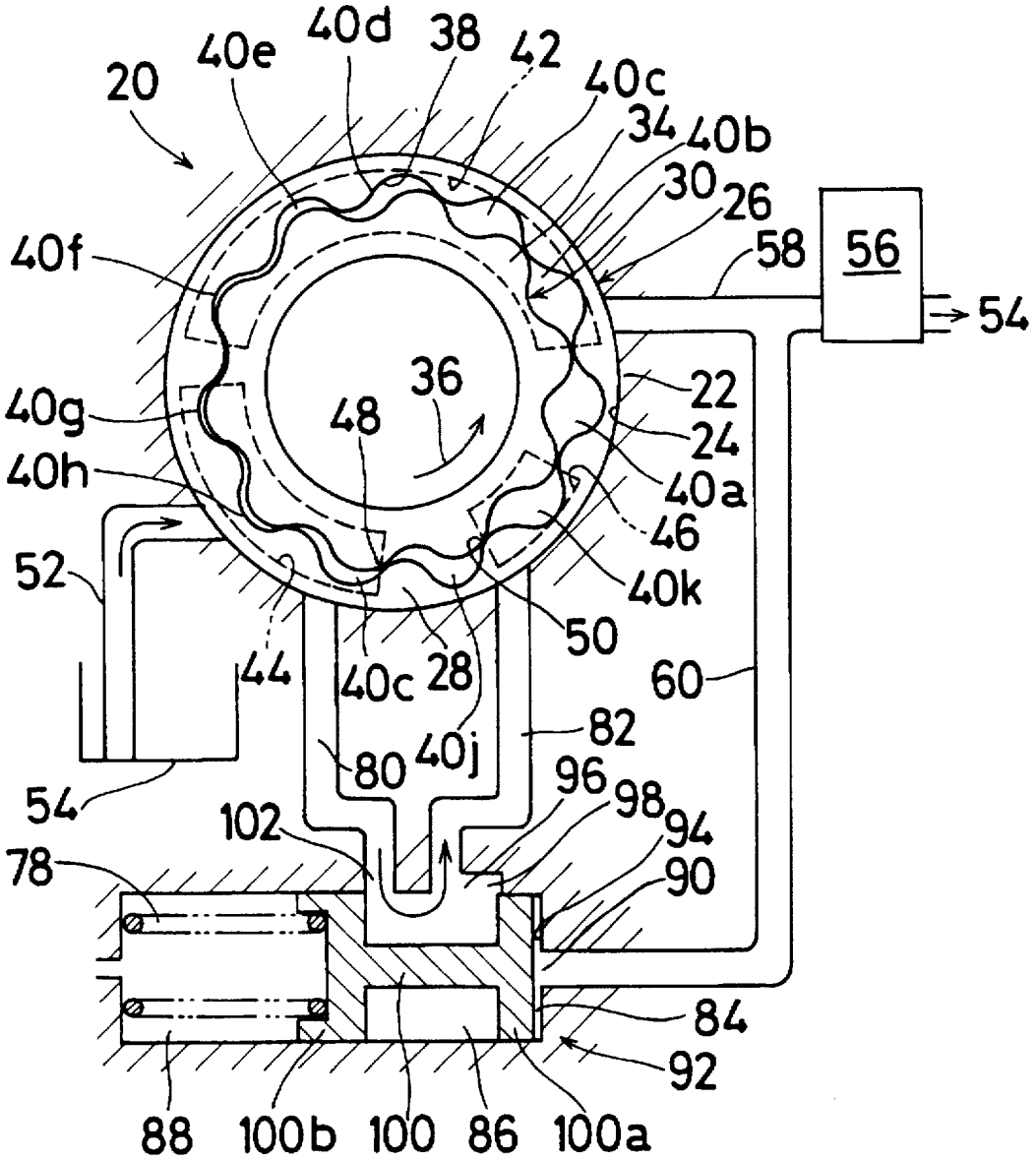
FIG. 6 is a diagrammatic illustration view, similar to FIG. 1, of the second embodiment in accordance with the present invention.
Figure 7:
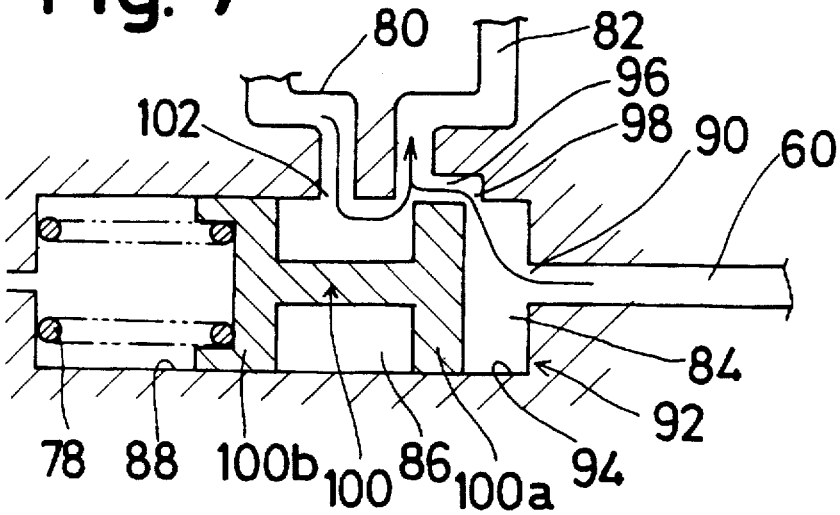
FIG. 7 is a sectional view of a valve of the second embodiment when the rotor rotates at bottom middle speed, in accordance with the present invention.

When the revolving speed of the internal combustion engine (the inner rotor 30) is less than N1 as shown in FIG. 5, the pressure of the hydraulic-oil-delivery passage 58 does not slide the spool 100 against the spring 78 so that the suction port 44 and the suction port 46 are communicated with each other, as shown in FIG. 6. When the revolving speed of the internal combustion engine is from N1 to N2 as shown in FIG. 5, the spool-actuating force is increased to overcome the urging force of the spring 78 and, accordingly, as can be understood from FIG. 7, the spool 100 is moved in the leftward direction while contracting the spring 78 elastically. Thus, the spool 100 of the control valve 92 is placed at the transition condition as shown in FIG. 7. The first valve port 90 communicates with the third valve port 96 via the side passage 98.

Figure 8:
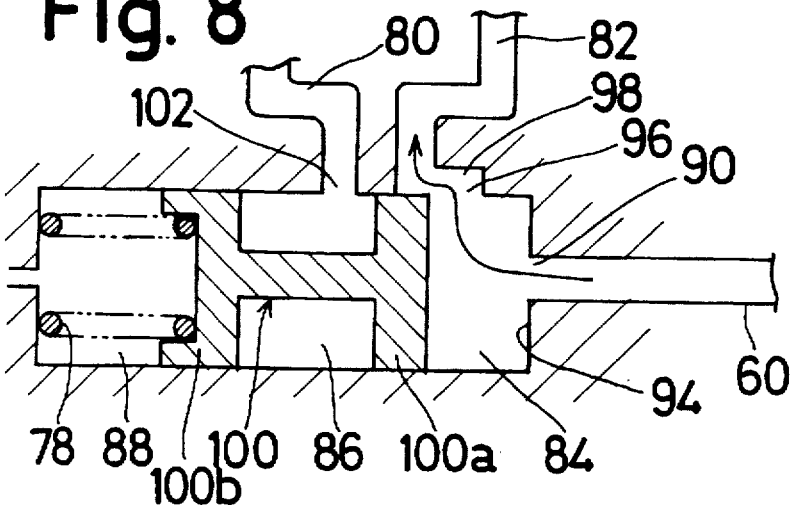
FIG. 8 is a sectional view of the valve of the second embodiment when the rotor rotates at upper middle speed, in accordance with the present invention.

When the revolving speed of the internal combustion engine is from N2 to N3 as shown in FIG. 5, the spool 100 of the control valve 92 is placed at the second condition, as illustrated in FIG. 8. In the second condition, the spool portion 100*a* cuts the hydraulic oil flow between a second value port 102 and the third valve port 96, and communicates the first valve port 90 with the third valve port 96. The suction port 44 (the pockets 40*g* through 40*i*) sucks the hydraulic oil from the oil pan 54. At the same time, the suction port 46 sucks the hydraulic oil from the hydraulic-oil-delivery passage 58 via the first branch passage 60.

Figure 9:
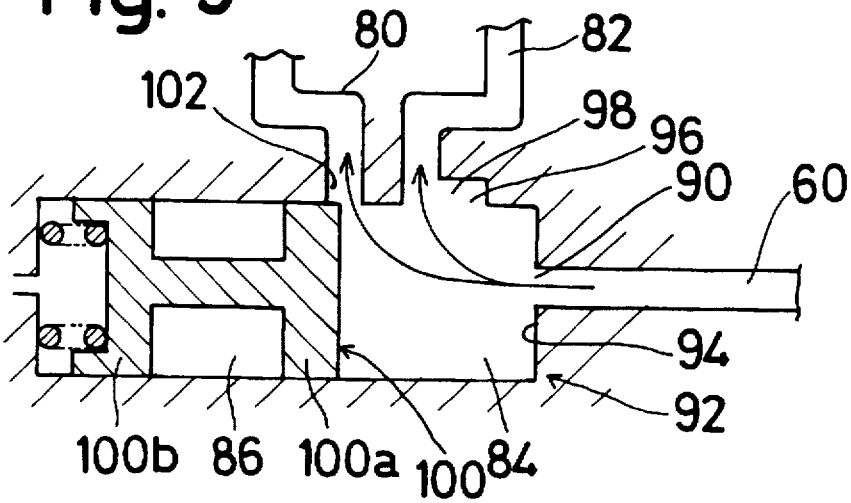
FIG. 9 is a sectional view of a valve of the second embodiment when the rotor rotates at high speed, in accordance with the present invention.

When the revolving speed of the internal combustion engine is more than N3 as shown in FIG. 5, the spool 100 of the control valve 92 is placed at the third condition as shown in FIG. 9. In the third condition, the first valve port 90 communicates with both the second valve port 96 and the third valve port 103. Therefore, both the suction ports 44 and 46 suck the hydraulic oil from the hydraulic-oil-delivery passage 58.

Other than the control valve 92 and the branch passages from the hydraulic-oil-delivery passage 58 to the control valve 92, this modified version is constructed in the same manner as the first preferred embodiment illustrated in FIG. 1. Therefore, the component elements functioning similarly are designated with the same reference numerals, and will not be detailed herein.

Figure 10:
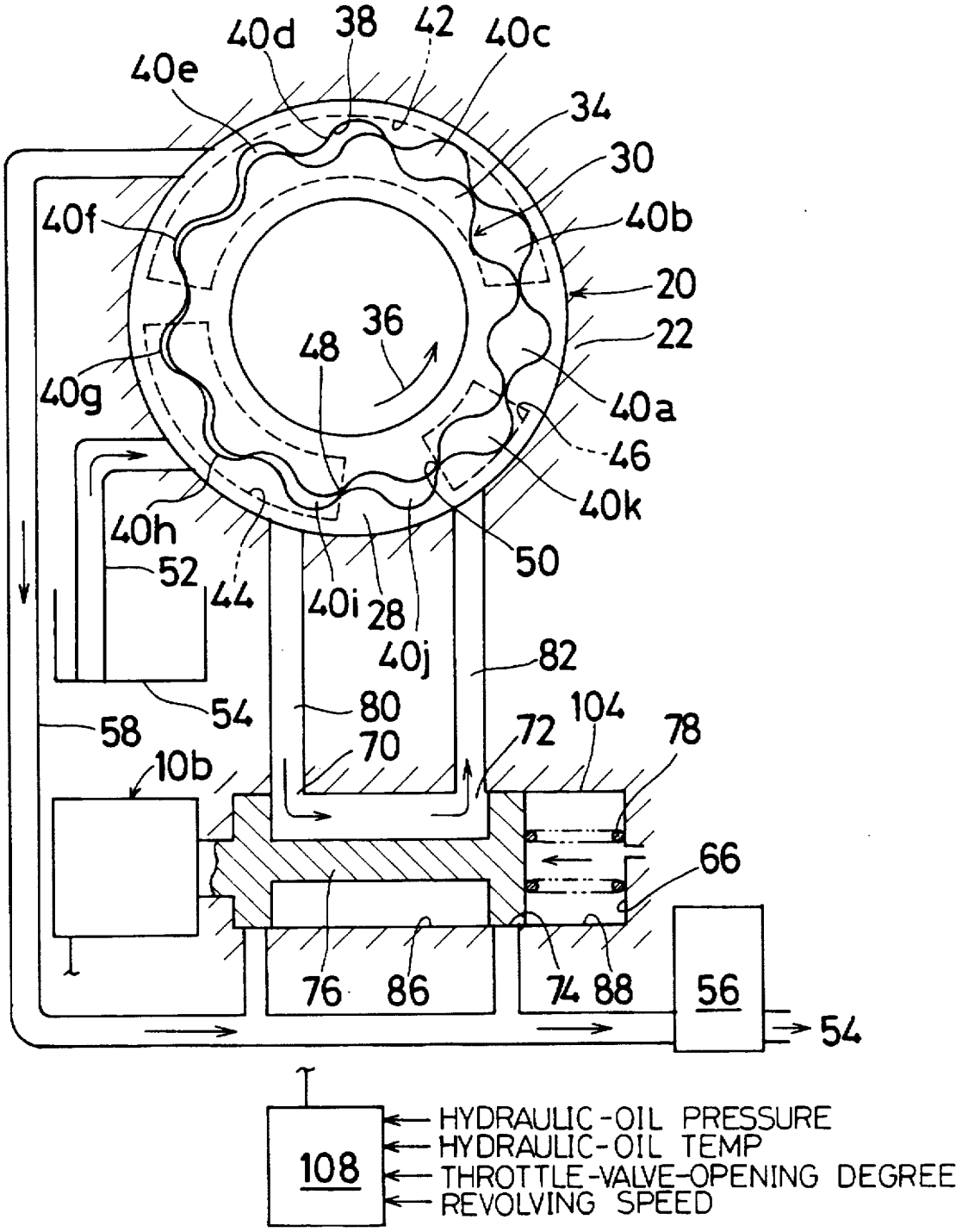
FIG. 10 is a diagrammatic illustration view, similar to FIG. 1, of the third embodiment in accordance with the present invention.

FIG. 10 illustrates another modified version of the first preferred embodiment. In this modified version, a control valve 104 is actuated by known proportional electromagnetic control means 106. The proportional electromagnetic control means 106 is controlled by output signals, which are outputted by an electric control device 108 in response to a hydraulic-oil pressure in the hydraulic-oil-delivery passage 58, a hydraulic-oil temperature, an opening degree of a throttle valve, and a revolving speed of the internal combustion engine.

Other than the proportional electromagnetic control means 106, the electric control device 108 and the control valve 104, this modified version is constructed in the same manner as the first preferred embodiment illustrated in FIG. 1. Therefore, the component elements functioning- similarly are designated with the same reference numerals, and will not be detailed herein.

In this modified version, the electric control device 108 detects the hydraulic-oil pressure in the hydraulic-oil-delivery passage 58, the hydraulic-oil temperature, the opening degree of a throttle valve, and the revolving speed of the internal combustion engine directly or indirectly, and outputs the valve-actuating signals in response to the detected signals. The control valve 104 is actuated in accordance with the valve-actuating signals so that the presented oil pump apparatus exhibits the outlet-pressure characteristic shown in FIG. 5.

Figure 11:
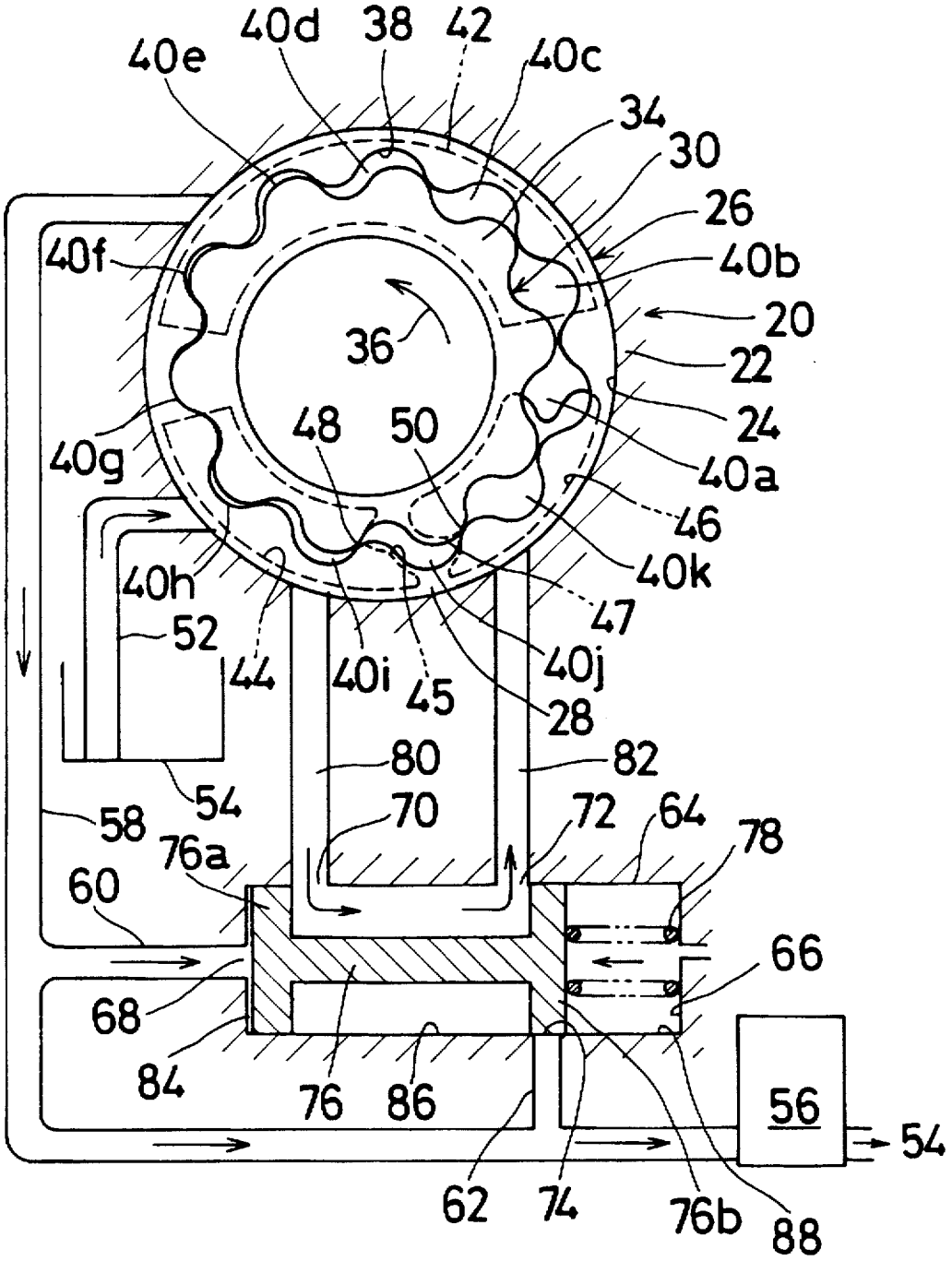
FIG. 11 is a diagrammatic illustration view, similar to FIG. 1, of the forth embodiment, in accordance with the present invention.
Figure 12:
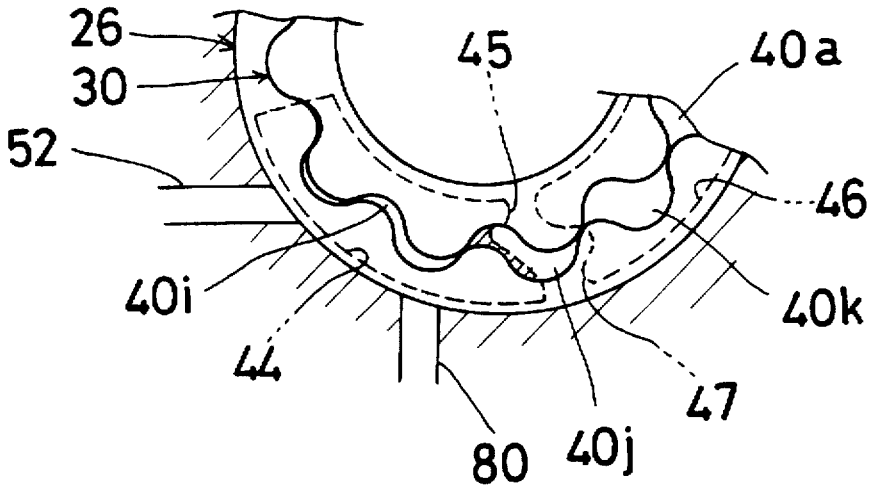
FIG. 12 is an enlarged fragmentary diagrammatic illustration view of FIG. 11 in accordance with the present invention.
Figure 13:
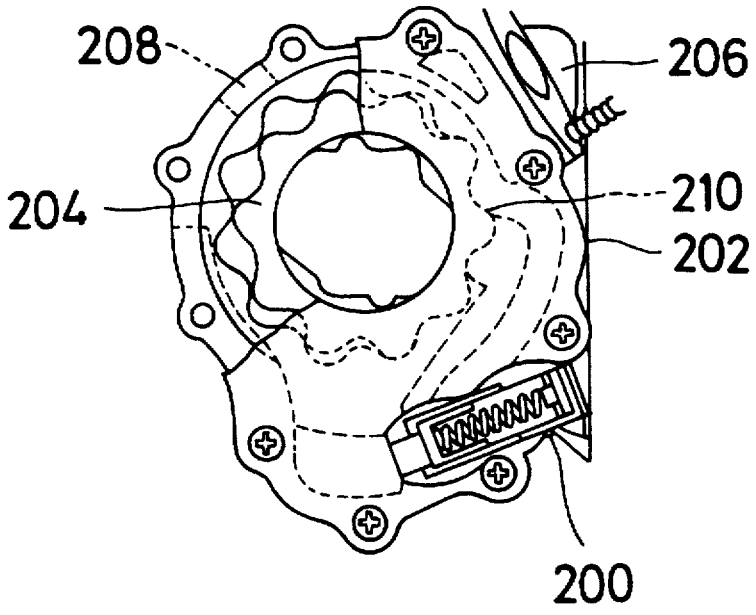
FIG. 13 is a diagrammatic illustrative view of an oil pump apparatus according to the prior art.

FIGS. 11 and 12 illustrate another modified version of the first preferred embodiment. In this modified version, the opposite side walls of the suction ports 44 and 46 are concave walls 45 and 47. Therefore, the concave walls 45 and 47 prevent the suction ports 44 and 46 from communicating with each other and obtain the wide opening volume of the suction ports 44 and 46 so that the oil pump of the oil pump apparatus is able to suck the hydraulic oil efficiently.

Other than the concave walls 45 and 47 of the suction ports 44 and 46, this modified version is constructed in the same manner as the first preferred embodiment illustrated in FIG. 1. Therefore, the component elements functioning similarly are designated with the same reference numerals, and will not be detailed herein.

Although the present invention has been fully described in connection with the preferred embodiment thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. An oil pump apparatus comprising:

an oil pump housing;

a rotor located in the oil pump housing, the rotor forming a first set of pockets having a capacity increasing toward a rotating direction of the rotor and a second set of pockets having a capacity decreasing toward the rotating direction of the rotor;

a plurality of suction ports connected with the first set of pockets, each of the suction ports being isolated from other adjacent suction ports;

a discharge port connected with the second set of the pockets; and a control valve operatively positioned to control fluid flow through said plurality of suction ports and said discharge port wherein the control valve is operatively connected to select between a first condition in which the control valve connects the suction ports and a second condition in which the control valve connects the discharge port with one of the suction ports and cuts off said other suction ports.

2. An oil pump apparatus as set forth in claim 1 wherein the control valve is operatively connected to select between the first condition if the pressure of the discharge port is lower than a predetermined pressure and the second condition if the pressure of the discharge port is higher than a predetermined pressure.

3. An oil pump apparatus as set forth in claim 1, further comprising a control means for outputting a control signal to make the control valve select between the first condition and the second condition in response to at least one of the pressure of the discharge port, a temperature of the oil, an opening degree of a throttle valve and a revolving speed of an engine.

4. An oil pump apparatus as set forth in claim 1 wherein the control valve is operatively connected to select between the first condition wherein the control valve connects the suction ports, the second condition wherein the control valve connects the discharge port with one of the ports and cuts off said other suction ports and a third condition which the control valve connects the discharge port with all the suction ports and cuts all the suction ports off.

5. An oil pump apparatus as set forth in claim 4 wherein the control valve switches from the first condition, to the second condition to the third condition according to the pressure increase of the discharge port.

6. An oil pump apparatus as set forth in claim 4, farther comprising a control means for outputting a control signal to make the control valve to select between one of the first condition the second condition and the third condition in response to at least one of the pressure of the discharge port, a temperature of the oil, an opening degree of a throttle valve and a revolving speed of an engine.

* * * * *